US009300028B2

(12) United States Patent
Morton et al.

(10) Patent No.: US 9,300,028 B2
(45) Date of Patent: Mar. 29, 2016

(54) FREQUENCY SELECTIVE LIMITER

(71) Applicant: Raytheon Company, Waitham, MA (US)

(72) Inventors: Matthew A. Morton, Reading, MA (US); Francois Y. Colomb, Westford, MA (US); Robert E. Leoni, Somerville, MA (US); Colin S. Whelan, Wakefield, MA (US); Traugott Carl Ludwig Gerhard Soliner, Winchester, MA (US)

(73) Assignee: Raytheon Company, Waltham, MA (US)

( * ) Notice: Subject to any disclaimer, the term of this patent is extended or adjusted under 35 U.S.C. 154(b) by 185 days.

(21) Appl. No.: 14/077,909

(22) Filed: Nov. 12, 2013

(65) Prior Publication Data

US 2015/0130564 A1 May 14, 2015

(51) Int. Cl.

| | |
|---|---|
| ***H01P 9/00*** | (2006.01) |
| ***H01P 9/02*** | (2006.01) |
| ***H01P 1/22*** | (2006.01) |
| *H01P 1/203* | (2006.01) |

(52) U.S. Cl.

CPC *H01P 9/02* (2013.01); *H01P 1/227* (2013.01); *H01P 9/00* (2013.01); *H01P 1/2039* (2013.01)

(58) Field of Classification Search

CPC ..... H01P 1/203; H01P 1/2039; H01P 1/227; H01P 9/02; H01P 9/00; H01P 1/218

USPC ..... 333/116, 157, 158, 161, 162, 163, 17.2

See application file for complete search history.

(56) References Cited

U.S. PATENT DOCUMENTS

| | | | | |
|---|---|---|---|---|
| 4,605,911 | A * | 8/1986 | Jin | 333/144 |
| 5,023,573 | A * | 6/1991 | Adam | 333/17.2 |
| 7,656,167 | B1 * | 2/2010 | McLean | 324/637 |
| 2011/0043299 | A1 * | 2/2011 | Ding et al. | 333/116 |

OTHER PUBLICATIONS

Ciersiang Chua, Sheel Aditya, Julius M. Tsai, Min Tang, Zhongxiang Shen, Microfabricated Planar Helical Slow-Wave Structures Based on Straight-Edge Connections for THz Vacuum Electron Devices, Terahertz Science and Technology, ISSN 1941-7411, vol. 4, No. 4, Dec. 2011, pp. 208-229.

* cited by examiner

*Primary Examiner* — Benny Lee
*Assistant Examiner* — Jorge Salazar, Jr.
(74) *Attorney, Agent, or Firm* — Daly, Crowley, Mofford & Durkee, LLP

(57) ABSTRACT

A selective frequency limiter having a magnetic material and a slow wave structure disposed to magnetically couple a magnetic field, produced by electromagnetic energy propagating through the slow wave structure, into the magnetic material.

5 Claims, 9 Drawing Sheets

FREQUENCY SELECTIVE LIMITER

TECHNICAL FIELD

This disclosure relates generally to frequency selective limiter.

BACKGROUND

As is known in the art, a Frequency Selective Limiter (FSL) is a nonlinear passive device that attenuates signals above a predetermined threshold power level while passing signals below the threshold power level. A key feature of the FSL is the frequency selective nature of the high-power limiting: low power signals close in frequency to the limited signals are unaffected. In this sense, the FSL acts as a high-Q (>1000 demonstrated) notch filter that automatically tunes to attenuate high power signals within a narrow frequency band as illustrated in FIGS. 1A, 1B and 1C which illustrate the frequency selectivity of a typical YIG FSL; the frequency response of: an input to the FSL being illustrate in FIG. 1A, the transmission loss through the FSL being illustrated in FIG. 1B, it being noted that there is significant attenuation to the frequency components in the input signals having power levels above the predetermined power threshold level, $P_{TH}$ (FIG. 1A) while the frequency components in the input signals having power levels below the predetermined power threshold level, $P_{TH}$ pass through the FSL unattenuated (except for by the small signal losses (resistive losses, impedance mismatch, etc.) and output power spectra being illustrated in FIG. 1C, for multiple weak and strong signals. With FSL, the power threshold level is set primarily by the structure of a ferrite material. For example, single-crystal YIG material is a ferrite material that provides a lower power threshold than polycrystalline YIG, which is then lower than hexaferrite materials. The difference in power threshold between these materials is on the order of 10-20 dB, with single-crystal YIG providing the lowest of around 0 to +10 dBm. As is also known in the art, ferrite FSLs rely on the non-linear response of a magnetized ferrite material. Above a critical RF magnetic field level the spin precession angle saturates in the ferrite and coupling to higher order spin-waves starts to occur. RF energy fed to the FSL is coupled efficiently to spin-waves at approximately one-half the signal frequency and then converted to heat.

The threshold power levels for the onset of limiting range from <−30 dBm for magnetostatic wave FSLs to >40 dBm for polycrystalline ferrite in subsidiary resonance FSLs. The critical RF magnetic field is directly proportional to the spin wave linewidth of the ferrite material. Liquid Phase Epitaxy (LPE) Yttrium-Iron-Garnet (YIG) is typically used because it has the narrowest spin-wave linewidth of all measured materials, on the order of 0.20.5 Oersted (Oe). This single crystal YIG approach provides the lowest insertion loss for weak signals, the highest-Q filtering response, and provides a power threshold on the order of 0 dBm—collectively making the material the most attractive for a wide variety of applications. A typical implementation of an FSL includes a strip conductor disposed between a pair of ground plane conductors in a stripline microwave transmission structure using two YIG slabs or films for the dielectric, as shown in FIG. 2, to couple the magnetic energy of the interfering signal into the magnetic material. Permanent biasing magnets are mounted to the sides, as shown, or may be mounted to the top and bottom of the structure. The strength of the magnetic field within the structure establishes the operating bandwidth of the limiter. An electro-magnet may be used in which case a wire, not shown, is wrapped around the entire structure to provide windings in a direction perpendicular to the stripline. DC current flows through the windings to provide a bias magnetic field. The bias is selected to establish the operating bandwith of the limiter. The slab thickness is generally 100 um or less because of the difficulty in growing thick YIG films, requiring stripline widths on the order of 40 um to achieve an input impedance $Z_0$ matched closely to 50 ohms. This approach is simple to fabricate and provides adequate magnetic fields to realize a critical power level of approximately 0 dBm when using single crystal YIG material. One method of reducing the power level threshold of the FSL is to use a lower input impedance stripline (i.e., less than 50 ohms); however, at the cost of degraded return loss. Thus, when using a lower input impedance structure, an impedance matching structure is sometimes used to improve the impedance match; however, this technique reduces the bandwidth and increases the insertion loss of the FSL; the approach reduces the resistive losses associated with the transmission structure for weak signals, and slightly increases the magnetic coupling of the signals with the ferrite material.

SUMMARY

In accordance with the present disclosure, a slow wave structure is provided having a magnetic material to magnetically couple a magnetic field, produced by electromagnetic energy propagating through the slow wave structure, into the magnetic material.

In one embodiment, the slow wave structure has different impedances as the electromagnetic energy propagates through the slow wave structure.

In one embodiment, the impedances change periodically as the electromagnetic energy propagates through the slow wave structure.

In one embodiment, the slow wave structure has an input impedance $Z_0$ and the impedances periodically change from an impedance greater than $Z_0$ to an impedance less than $Z_0$ as the electromagnetic energy propagates through the slow wave structure.

In one embodiment, a frequency selective limiter is provided having a magnetic material and a slow wave structure disposed to magnetically couple a magnetic field, produced by electromagnetic energy propagating through the slow wave structure, into the ferromagnetic material.

In one embodiment, the slow wave structure of the limiter is a transmission having a first transmission line section disposed between a pair of second transmission line sections.

In one embodiment, the transmission line has an input impedance, $Z_0$ and the first transmission line section has an impedance $Z_H$ higher than $Z_0$ and the pair of second transmission line sections have an impedance lower than $Z_0$.

In one embodiment, the first transmission line section and the pair of second transmission lines sections each have a length shorter than a nominal operating wavelength of the electromagnetic energy propagating through the slow wave structure.

In one embodiment, the first transmission line section and the pair of second transmission lines sections comprise: a strip conductor and at least one ground plane conductor, and wherein the magnetic material is disposed between the strip conductor and the at least one ground plane conductor.

In one embodiment, the first transmission line section and the pair of second transmission lines sections comprise: a strip conductor and a pair of ground plane conductors.

In one embodiment, the slow wave structure is a helical structure having the magnetic material disposed as a core within the helical structure.

The inventors have recognized that while slow wave structures (SINS) have been used to produce larger time delays for the same physical length, they exploit the property of the SWS in producing locally-strong magnetic fields. The structure creates locally-strong magnetic coupling, thereby decreasing the effective power threshold via electrical design rather than modification to the material properties. Further, using periodic segments of very low characteristic impedances, the inventors increase the magnetic interaction of the microwave signals with the magnetic, e.g., YIG substrate, thereby reducing the effective power threshold of when nonlinearity occur and thereby achieves a lower threshold for the onset of the desired nonlinear behavior. This enables the use of lower-cost polycrystalline YIG material with similar threshold and loss performance to single-crystal YIG substrates, or when used with single-crystal material enables lower threshold power for improved compatibility with sensitive receiver architectures. Additionally, the ability to design for localized strengths of magnetic field enable engineering of the FSL transfer characteristics of its limiting region of operation without changes to the material itself. Further, when high and low impedance segments of equal length are used and the product of their native characteristic impedances is equal to $Z_0^2$ and a 50Ω characteristic impedance is maintained for the composite transmission line.

In one embodiment, the strip conductor comprises a first strip conductor section disposed between a pair of second strip conductor sections, and wherein the first strip conductor section is separated from a portion of the pair of ground plane conductors disposed over and under the first strip conductor section a first distance D1, and wherein the pair of second strip conductor sections are separated from portions of the ground plane conductor disposed over and under the pair of second strip conductor sections a second distance D2, where D1 and D2 are different distances. In this embodiment, the strip conductor width has been set to a constant that minimizes small-signal insertion loss, and the impedance is set by varying the vertical distance of the ground planes using conductive vias. While the limiter is matched to 50Ω, the numerous low-impedance sections of the slow wave structure couple significantly higher magnetic energy into the magnetic material, locally reducing the power threshold. This reduces the total effective power threshold, without also degrading the return loss or instantaneous bandwidth of the device. The strip conductor width is been set to a constant that minimizes small-signal insertion loss, and the impedance is set by varying the vertical distance of the ground planes using conductive vias. While the complete FSL component is matched to 50Ω, the numerous low-impedance sections of the slow wave structure couple significantly higher magnetic energy into the material, locally reducing the power threshold. This reduces the total effective power threshold, without also degrading the return loss or instantaneous bandwidth of the device.

It is noted that with a slow wave structure, repeating pair of high and low impedance segments is used where each segment is much less than a wavelength (λ, where λ is the nominal operating wavelength of the slow wave structure) (in practice, <(λ)/10, but the smaller the better). Because the segments are electrically small, the effective impedance of the entire transmission line structure is the square root of the product of the two impedances. This is why it is desired the product be $Zo^2$. For example, a structure could have 100 ohm and 25 ohm impedance segments; however, 10 ohms and 250 ohms, or even 5 ohms and 500 ohms, may be preferred. The difficulty here is achieving the >100 ohm line; however, with this last embodiment using the vertical vias for the low impedance sections makes this easier to achieve as the ground plane is moved away from the strip conductor sections to achieve the high impedance rather than making the center conductor extremely small.

Further, the FSL performance parameters can be tuned via design changes in the transmission line structure rather than optimize material properties of the dielectric. Here, the power threshold is now a function of both the material properties and of the transmission line structure. Because the slow wave structure features stronger magnetic coupling into the magnetic material, the effective threshold of power is lower because less RF power is needed to achieve the same magnetic field strength. An additional benefit is the ability to design for a specific threshold power. It is much easier to design a slow wave structure to provide a specific magnetic field strength (hence threshold power level, $P_{TH}$) than it is to tune the material properties of the magnetic material.

Further, while the helical slow wave structure has been used as a slow wave structure in TWTAs (traveling wave tube amplifiers) to slow the RF signal down such that the speed is the same as electrons that are traveling down the length of the tube through the center of the helical so that the electrons generated from an electron gun terminate on the other side of the tube and that because the electrons and RF signals are traveling at the same speed, they interact and the intensity of the RF signal is increased as it propagates down the coil; the inventors have recognized the helical structure can be used intensify the magnetic coupling of the RF signal with a magnetic material at the center or core of the helical to now, instead of interacting with the electron beam, interacts with the magnetic material and that this interaction will causes spinwaves which dissipate heat in the crystal structure of the magnetic material at half the frequency of the RF signal to attenuate the signal. These spinwaves dissipate the energy as heat.

The details of one or more embodiments of the disclosure are set forth in the accompanying drawings and the description below. Other features, objects, and advantages of the disclosure will be apparent from the description and drawings, and from the claims.

DESCRIPTION OF DRAWINGS

FIG. 1A showing the frequency spectrum of an input signal to the FSL; FIG. 1B showing the transmission loss through the FSL, it being noted that there is significant attenuation to the frequency components in the input signals having power levels above the predetermined power threshold level, $P_{TH}$ (FIG. 1A) while the frequency components in the input signals having power levels below the predetermined power threshold level, $P_{TH}$ pass through the FSL unattenuatted (except for by the small signal losses (resistive losses, impedance mismatch, etc.); and FIG. 1C showing the output power spectra of the FSL for multiple weak and strong signals;

FIG. 5A being a cross sectional view of a FSL having a helical slow wave structure formed on a magnetic substrate, the substrate having a helical coil conductor disposed around it, the substrate being bonded to a dielectric slab, the dielectric slab having a metal trace to provide a ground conductor for the FSL structure; FIG. 5B being a plan view of a top of the magnetic substrate; FIG. 5C being a plan view of a bottom plan of the magnetic substrate; FIG. 5D being a plan view of bottom of the lower dielectric slab; and FIG. 5E being a diagrammatical isometric of the FSL having the helical slow wave structure of FIGS. 5A-5D; and wherein the cross section of FIG. 5A is taken along line 5A-5A in FIG. 5D, the top view of FIG. 5B being designated by the line 5B-5B in FIG. 5A, the bottom view of FIG. 5C being indicated by the line 5C-5C in FIG. 5A, and the bottom view of FIG. 5D being indicated by the line 5D-5D in FIG. 5A.

Like reference symbols in the various drawings indicate like elements.

DETAILED DESCRIPTION

Figure 1A:
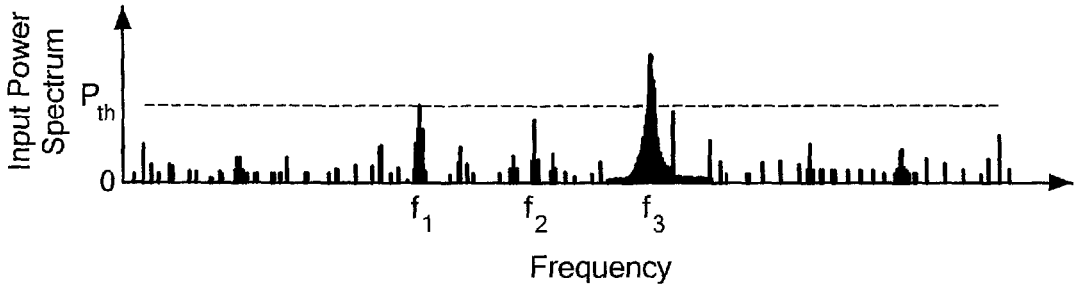
FIG. 1A PRIOR ART
FIGS. 1A, 1B and 1C illustrate the frequency response of an Frequency Selective Limiter (FSL) according to the PRIOR ART.
Figure 1B:
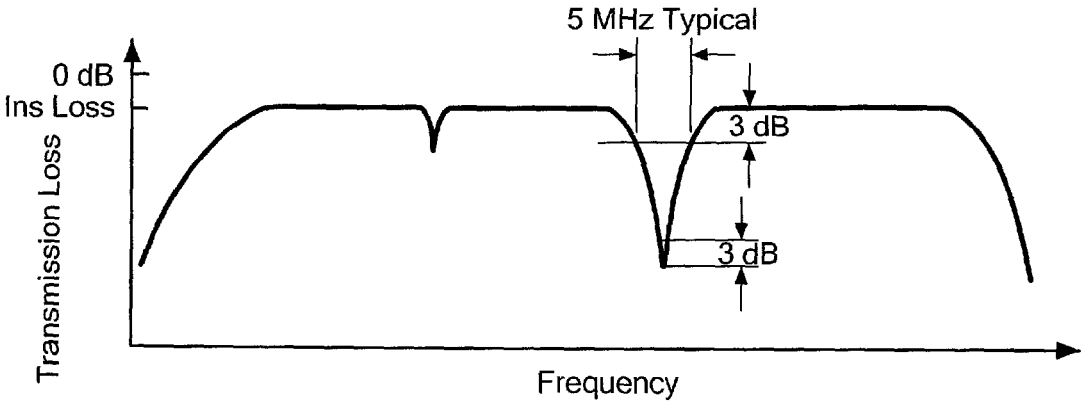
FIG. 1B PRIOR ART
Figure 1C:
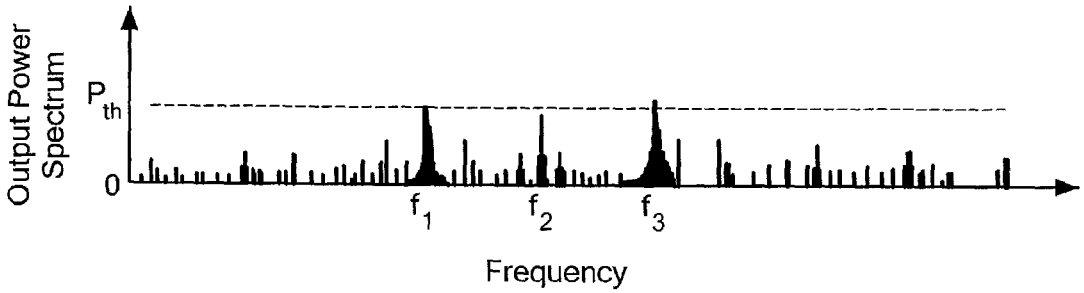
FIG. 1C PRIOR ART
Figure 2:
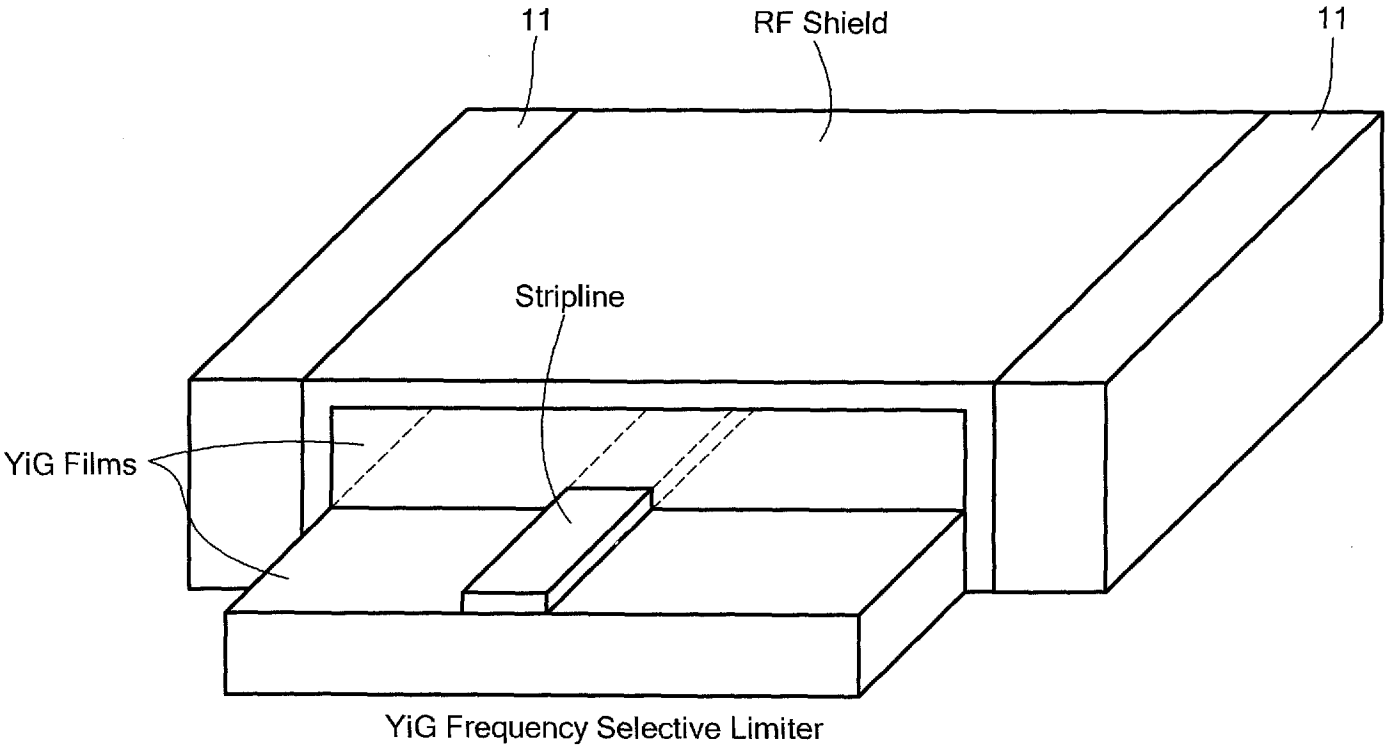
FIG. 2 PRIOR ART
FIG. 2 shows an FSL according to the PRIOR ART.
Figure 3:
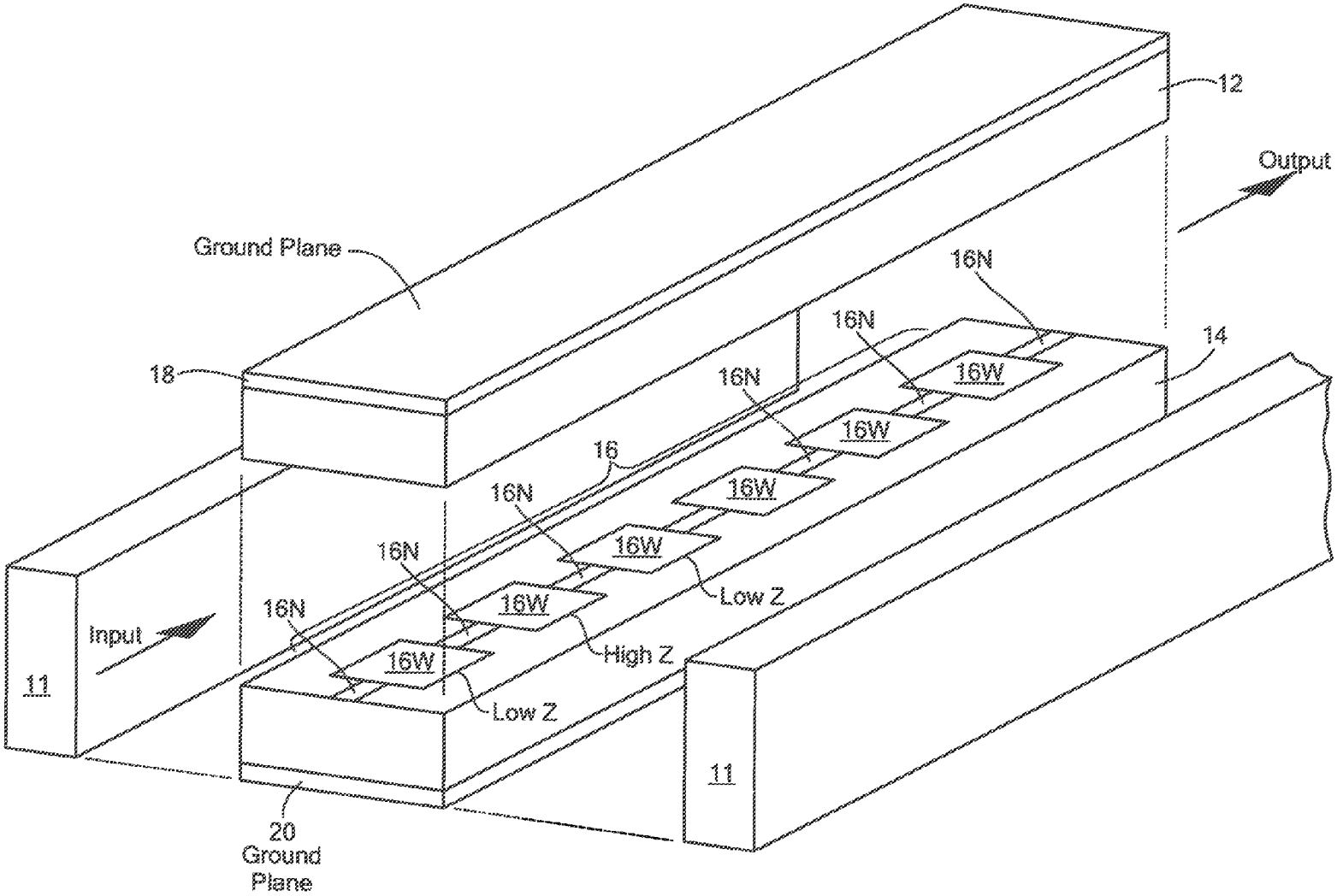
FIG. 3 is an exploded, isometric view of an FSL according to the disclosure.

Referring now to FIG. 3, a frequency selective limiter (FSL) 10 is shown. The limiter 10 is a slow wave structure comprising a stripline microwave transmission line having a 1 series of different impedances $Z_{HIGH}$ and $Z_{LOW}$ from an INPUT of the limiter 10 to an OUTPUT of the limiter 10. More particularly, the limiter 10 includes a pair magnetic members, slabs 12, 14, here, for example, ferrimagnetic slabs, such as, for example, YIG slabs, 12, 14, having a strip conductor 16 sandwiched between the slab and ground plane conductors 18, 20 on the outer surface of the magnetic slabs 12, 14, as shown. The strip conductor 16 varies in width between a narrow width sections 16N and wider width sections 16W, as shown. Here, the slow wave structure 10 has in input impedance $Z_0$ of 50 ohms; the narrow section 16N providing impedances of here for example, 250 ohms and the wider sections 16W providing here for example, 10 ohms. The length of each section is less than the nominal operating wavelength of the electromagnetic energy pass into the FSL. The impedance of each section is established by the width of the strip conductor of such section. The size and spacing of the wide and narrow section 16N and 16W provide the slow wave structure with the input impedance $Z_0$ of 50 ohms. Thus, the impedances of the narrow sections and wider sections 16N and 16W here periodically change from an impedance greater than $Z_0$ to an impedance less than $Z_0$ as the electromagnetic energy propagates through the slow wave structure 10. It is noted that a conventional pair of bias magnets, 11 here permanent magnets, for example, are mounted to the sides of the structure. The permanent biasing magnets 11 may be mounted to the top and bottom of the structure. The strength of the magnetic field within the structure establishes the operating bandwidth of the limiter. An electro-magnet may be used in which case a wire, not shown, is wrapped around the entire structure to provide windings in a direction perpendicular to the stripline. DC current flows through the windings to provide a bias magnetic field. The bias is selected to establish the operating bandwidth of the limiter.

The slow wave structure 10 couples the magnetic energy of the input interfering signal that has higher power level (a power level above the predetermined FSL power threshold $P_{TH}$) of the slow wave structure 10 into the magnetic material of the magnetic slabs 12, 14. In other words, the slow wave structure 10 is used to magnetically couple a magnetic field, produced by electromagnetic energy propagating through the slow wave structure, into the magnetic slabs 12, 14.

Figure 4:
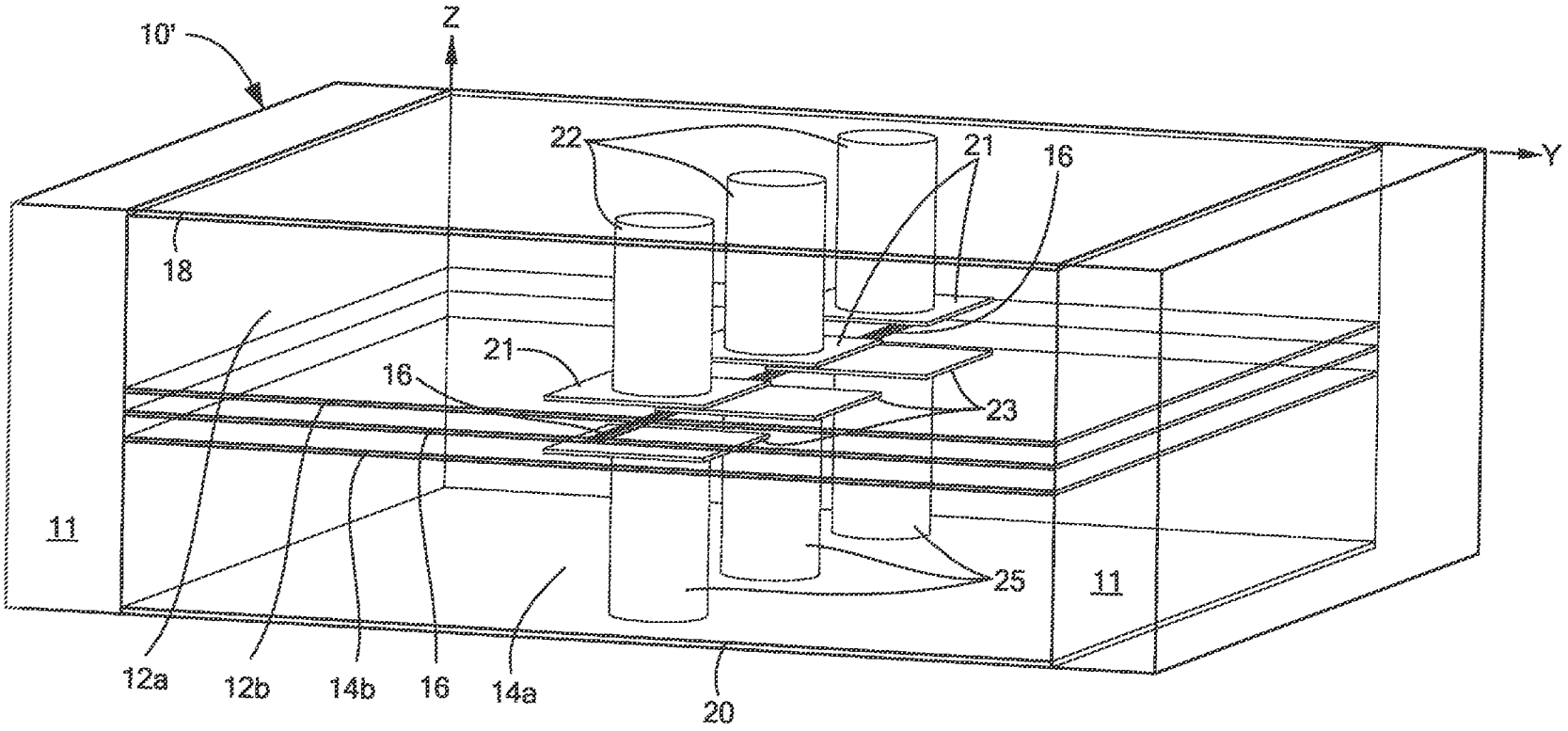
FIGS. 4 and 4A are diagrammatical isometric and cross sectional views, respectively, of an FSL according to another embodiment of the disclosure.
Figure 4A:
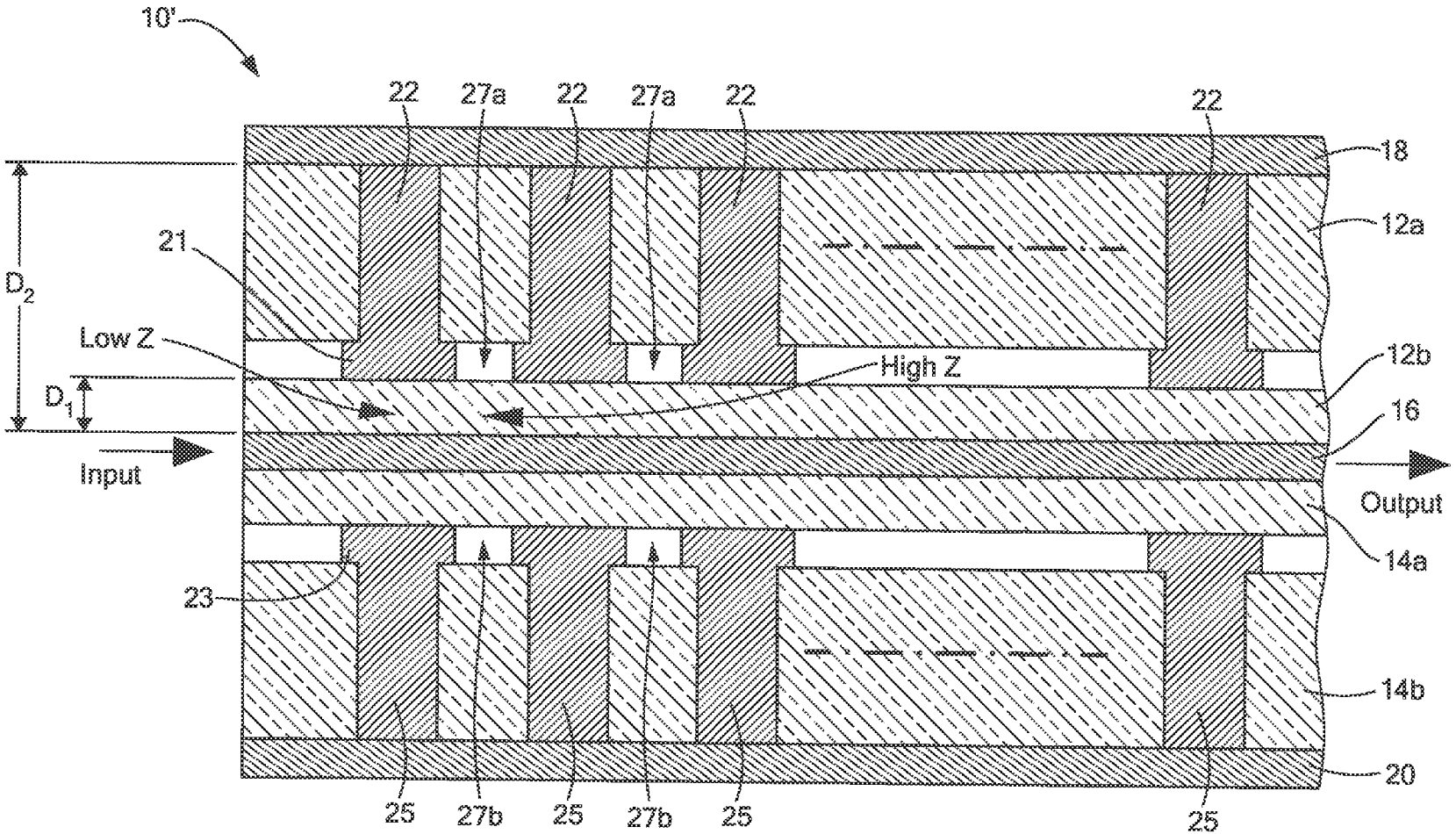
Figure 5A:
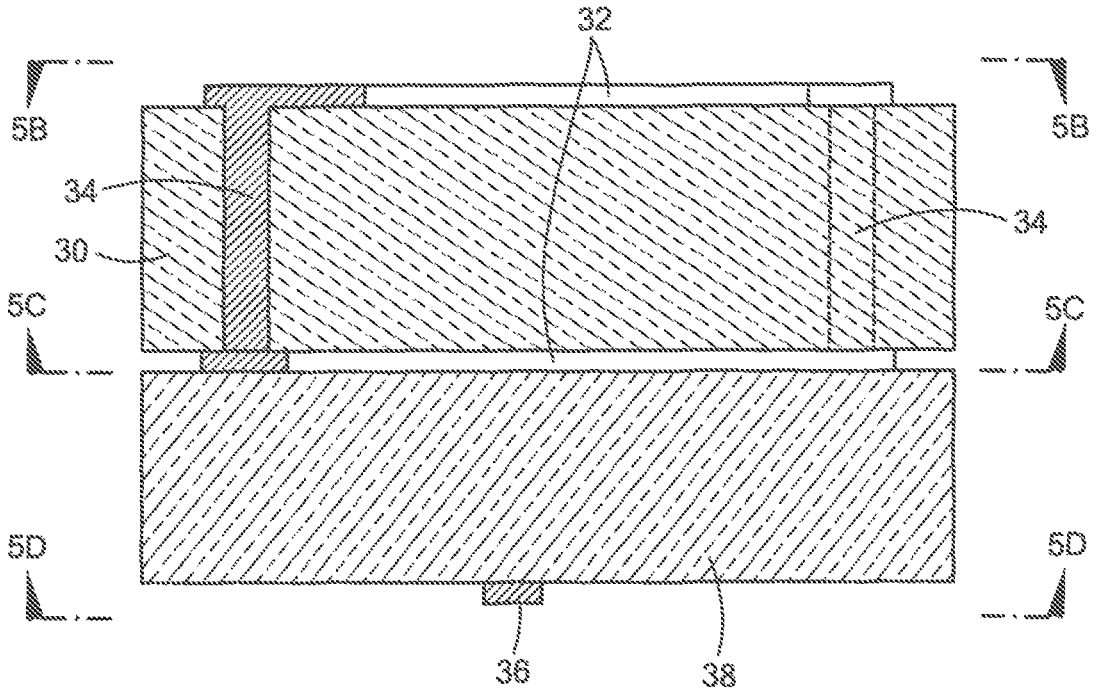
FIGS. 5A-5E, are different views of an FSL according to still another embodiment of the disclosure.
Figure 5B:
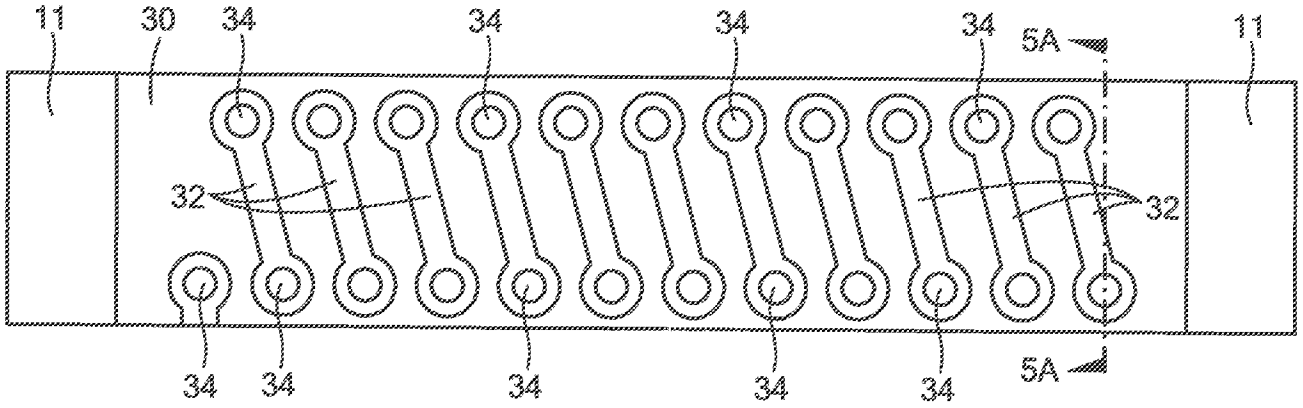
Figure 5C:
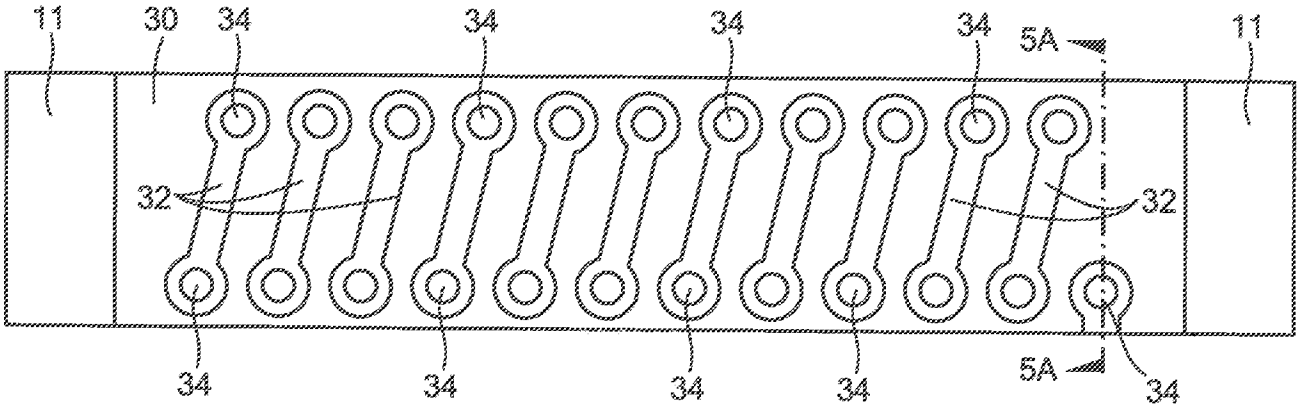
Figure 5D:
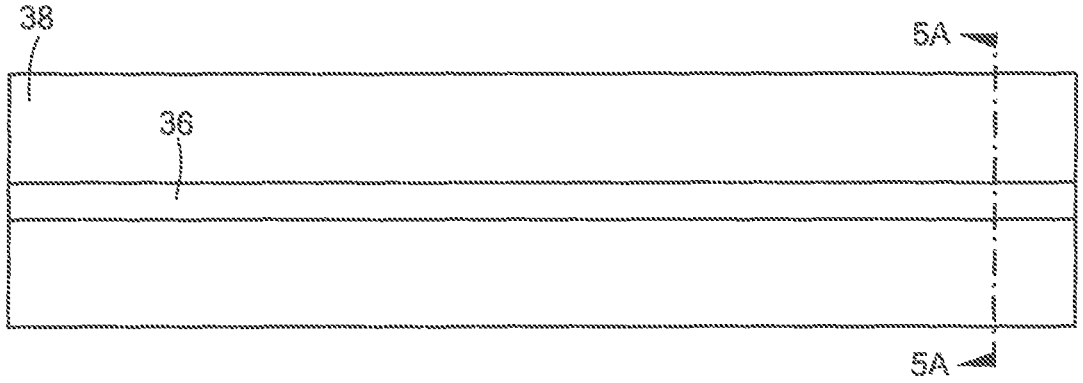
Figure 5E:
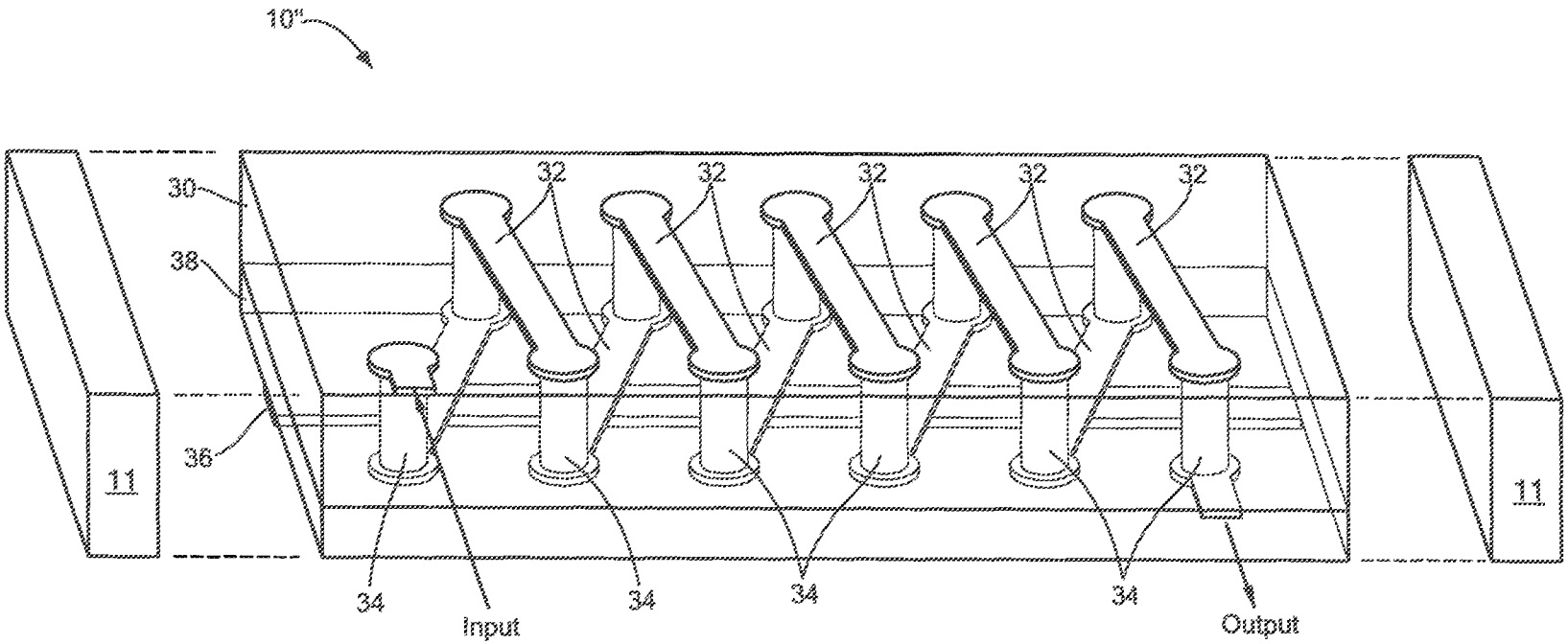

Referring now to FIGS. 4 and 4A, a slow wave structure FSL 10' is shown. The limiter 10' is a slow wave structure comprising a stripline microwave transmission line having a series of different impedances $Z_{HIGH}$ and $Z_{LOW}$ from an INPUT of the limier 10' to an OUTPUT of the limiter 10'. More particularly, the limiter 10' includes a two pairs magnetic slabs 12*a*, 12*b*, and 14*a*, 14*b*, haring a strip conductor 16 sandwiched between the slabs and ground plane conductors 18, 20 on the outer surface of the ferrimagnetic slabs 12*a* and 14*a*, as shown.

More particularly, a magnetic material, here for example, a ferrimagnetic slab 12*a*, has a ground plane conductor 18 on its outer surface and a series of conductive pads 21 laterally spaced by regions 27*a* on its inner surface, as shown. The conductive pads 12 are connected to the ground plane conductor 18 by conductive vim 22 passing through the slab 12*a* between the conductive pads 21 and the ground plane conductor 18, as shown.

Disposed between the upper surface of the strip conductor 16 and the conductive pads 21 is the ferrimagnetic slab 12*b*, as shown.

Similarly, magnetic slab 14*a*, here, also, for example, a ferrimagnetic slab, has a ground plane conductor 20 on its out surface and a series of conductive pads 23 laterally spaced by regions 27*b* on its inner surface, as shown. The conductive pads 23 are connected to the ground plane conductor 20 by conductive vias 25 passing through the slab 14*a* between the conductive pads 23 and the ground plane conductor 20, as shown.

Disposed between the bottom surface of the strip conductor 16 and the conductive pads 23 is the ferrimagnetic slab 14*b*, as shown.

It is noted that the distance D1 between the conductive pads 21, 23, (and hence, in effect, the electrically connected ground plane conductors 18, 20) respectively, and the strip conductor 16 is greater that the distance D2 between the strip conductor 16 and the ground plane conductors 18, 20 in the regions 27*a*, 27*b*. Thus, the impedance in the regions 27*a*, 27*h* $Z_{HIGH}$ is greater than the impedance $Z_{LOW}$ in the regions having the conductive pads 21, 23. Hence, here again the slow wave structure 10' has in input impedance $Z_0$ of 50 ohms; the regions 27*a*, 27*b* providing impedances of here for example, 250 ohms and the regions through the conductive pads 21, 23 providing here for example, 10 ohms. The size and distance D1, D2, provide the slow wave structure with the input impedance $Z_0$ of 50 ohms. Thus, the impedances of again periodically change from an impedance greater than $Z_0$ to an impedance less than $Z_0$ as the electromagnetic energy propagates through the slow wave structure 10'. The impedance of each section is established by the distance D1 and D2.

In this embodiment, width of the strip conductor 16 is set to a constant that minimizes small-signal insertion loss, and the impedance is set by varying the vertical distance of the ground planes 18, 20 using vias 22. While the complete FSL component is matched to 500Ω, the numerous low-impedance sections of the slow wave structure couple significantly higher magnetic energy into the ferrimagnetic slabs, locally reducing the $P_{TH}$ power threshold. This reduces the total effective power threshold, without also degrading the return loss or instantaneous bandwidth of the device. Referring now to FIGS. 5A-5E, another embodiment of an FSL is shown. Here, the FSL is a helical slow wave structure 10" having a magnetic body 30 made of a magnetic, here ferrimagnetic (e.g., YIG) substrate 30, as shown). The substrate 30 provides a magnetic core, for a helical conductor or coil 32. The helical conductor 32 is used to create a strong magnetic field within the ferrimagnetic material center, or core 30 due to reinforcement from adjacent turns in the coil 32. The coil 32 is implemented with conductive vias 34 to connect the top side of the coil 32 to the bottom side of the coil 32. Since the magnetic field outside of the coil is relatively small, it may not be beneficial to have additional magnetic, for example, YIG substrates (not shown), outside of the coil structure 32. In one application, the ground reference for the coil includes a metal trace 36 defined on the bottom side of a supporting dielectric slab 38. The dielectric slab 38 is bonded to the bottom of the magnetic body 30, whereby the supporting dielectric is attached to the ferrimagnetic core (or substrate) containing the coil 32. In this application, the dielectric material of dielectric slab 38 is a non-magnetic material such as FR-4 or a Rogers Corporation, Rogers, CT laminate material. In one application, the lowest critical fields are achieved when the static and RF induced, magnetic fields are parallel.

It is noted that a pair of bias magnets 11, here permanent magnets, are included. The strength of the magnetic field within the structure establishes the operating bandwidth of the limiter. The coil structure is oriented perpendicular to the axial direction of the magnetic field produced by the magnets 11. For the case of biasing, it is noted that the permanent magnets 11 are disposed on either end of the coil rather than along the sides or the top and bottom.

A number of embodiments of the disclosure have been described. Nevertheless, it will be understood that various modifications may be made without departing from the spirit and scope of the disclosure. For example, the high and low impedance lines may be by varied using both the ground plane height and the width of the center conductor line. In another embodiment, in the helical slow wave embodiment, the ground plane reference could be manifested by placing the coil inside a metal container shield with air or dielectric gaps between the coil and the metal shield.

Accordingly, other embodiments are within the scope of the following claims.

What is claimed is:

1. In combination:

a ferromagnetic material; and a slow wave structure disposed to magnetically couple a magnetic field, produced by electromagnetic energy propagating through the slow wave structure, into the ferromagnetic material;

wherein the slow wave structure is a transmission line having a first transmission line section disposed between a pair of second transmission line sections;

wherein the first transmission line section and the pair of second transmission lines sections comprise: the first transmission line section having a strip conductor and a pair of ground plane conductors; and wherein the strip conductor comprises a first strip conductor section disposed between the pair of second transmission lines sections, and wherein the first strip conductor section is separated from a portion of the pair of ground plane conductors disposed over and under the first strip conductor section at a first distance D1, and wherein the pair of second transmission lines sections are separated from portions of the ground plane conductor disposed over and under the pair of second transmission lines sections at a second distance D2, where D1 and D2 are different distances.

2. In combination:

a ferromagnetic material; and a slow wave structure disposed to magnetically couple a magnetic field, produced by electromagnetic energy propagating through the slow wave structure, into the ferromagnetic material; and wherein the slow wave structure is a transmission line having an input impedance, $Z_0$ and wherein the transmission line includes a first transmission line section disposed between a pair of second transmission line sections, wherein the first transmission line section has an impedance $Z_H$ that is higher than $Z_0$ and the pair of second transmission line sections have an impedance that is lower than $Z_0$.

3. The combination recited in claim 2 wherein the first transmission line section and the pair of second transmission lines sections each have a length shorter than a nominal operating wavelength of the electromagnetic energy propagating through the slow wave structure.

4. A slow wave structure having a magnetic material to magnetically couple a magnetic field, produced by electromagnetic energy propagating through the slow wave structure, into the magnetic material; and wherein the slow wave structure has an input impedance $Z_0$ and wherein the impedances periodically change from an impedance greater than $Z_0$ to an impedance less than $Z_0$ as the electromagnetic energy propagates through the slow wave structure.

5. In combination:

a ferromagnetic material; and a slow wave structure disposed to magnetically couple a magnetic field, produced by electromagnetic energy propagating through the slow wave structure, into the ferromagnetic material;

wherein the slow wave structure is a transmission line having a first transmission line section disposed between a pair of second transmission line sections; and wherein the first transmission line section and the pair of second transmission lines sections comprise: the first transmission line section having a strip conductor and at least one ground plane conductor, and wherein the ferromagnetic material is disposed between the strip conductor and the at least one ground plane conductor; and wherein the strip conductor comprises a first strip conductor section disposed between the pair of second transmission lines sections, and wherein the first strip conductor section is separated from a portion of the at least one ground plane conductor disposed over the first strip conductor section at a first distance D1, and wherein the pair of second transmission lines sections are separated from portions of the at least one ground plane conductor disposed over the pair of second transmission lines sections at a second distance D2, where D1 and D2 are different distances.

* * * * *